United States Patent [19]

Claar et al.

[11] Patent Number: 4,951,981

[45] Date of Patent: Aug. 28, 1990

[54] ROTARY-LATCH LOCK

[75] Inventors: Klaus Claar, Gechingen; Jürgen Schrader, Stuttgart, both of Fed. Rep. of Germany

[73] Assignee: Daimler-Benz AG, Stuttgart, Fed. Rep. of Germany

[21] Appl. No.: 475,860

[22] Filed: Feb. 6, 1990

[30] Foreign Application Priority Data

Feb. 23, 1989 [DE] Fed. Rep. of Germany ..... 3905504

[51] Int. Cl.[5] ..... E05C 3/26

[52] U.S. Cl. ..... 292/216; 292/210

[58] Field of Search ..... 292/114, 210, 216, DIG. 71, 292/108, 153, DIG. 65, 280

[56] References Cited

U.S. PATENT DOCUMENTS

| | | | |
|---|---|---|---|
| 1,626,422 | 4/1927 | Mutispaugh | 292/216 |
| 2,301,221 | 11/1942 | Marple | 292/216 |
| 3,365,226 | 1/1968 | Shay | 292/216 |
| 3,620,560 | 11/1971 | Peters | 292/216 X |

FOREIGN PATENT DOCUMENTS

| | | |
|---|---|---|
| 2018197 | 4/1970 | Fed. Rep. of Germany . |
| 7241802 | 5/1975 | Fed. Rep. of Germany . |
| 2388115 | 11/1978 | France . |
| 1295710 | 11/1972 | United Kingdom . |

*Primary Examiner*—Richard E. Moore

*Attorney, Agent, or Firm*—Evenson, Wands, Edwards, Lenahan & McKeown

[57] ABSTRACT

A rotary-latch lock in which a forked rotary latch is blocked against pivoting from a position locking a closing bolt. A spring loaded detent edge of a catch member engages behind a centrally directed catch edge extending from a circumferential edge of the forked rotary latch. In order to prevent an unintentional release of the rotary-latch lock, when the latter is subjected to dynamic stress, the catch edge is a limiting edge of an approximately U-shaped catch recess into which the detent end of the catch member engages. A rear edge of the detent end is located at a distance and opposite a limiting edge of the catch recess. In the event of oscillating movements of the forked rotary latch, the limiting edge butts against the rear edge of the detent end. The limiting edge and the corresponding rear edge are designed over their length of mutual contact as return surfaces which, during the time when they butt against one another, transmit an acceleration force tending to move the detent in the direction of engagement.

7 Claims, 1 Drawing Sheet

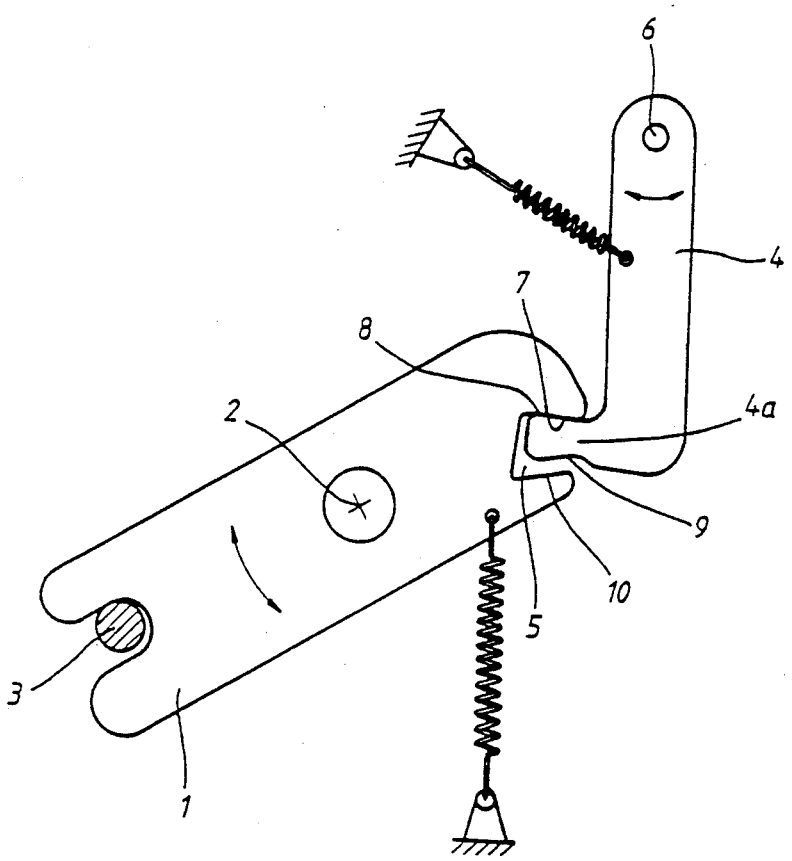
6
4
7
8
4a
2
9
10
5
3
1

ROTARY-LATCH LOCK

BACKGROUND AND SUMMARY OF THE INVENTION

The invention relates to a rotary-latch lock which comprises a forked rotary latch that is blocked against pivoting in a position where it locks a closing bolt through a spring-loaded catch member which has a detent edge that engages behind a centrally directed catch edge extending from a circumferential edge of the forked rotary latch.

Rotary-latch locks of this general type are already known from German Auslegeschrift No. 2,018,197 and are in widespread use as door locks of motor vehicles.

However, rotary-latch locks, in addition to their use in or on vehicles, can also be employed for other locking functions where high locking safety is required.

Nevertheless, the high locking safety of a rotary-latch lock can be impaired if exposed to high dynamic loads which lead to rotational oscillations of the forked rotary latch.

In motor-vehicle door locks, such rotational oscillations are brought about by relative movements which occur between the closing bolt and the forked rotary latch engaging around it and which are attributable to body distortions or the like.

Because of rotational oscillations of the forked rotary latch, the detent pawl can be vibrated which can result in a movement of the detent pawl counter to its spring-loading direction. Under extreme circumstances, this can lead to "creeping movement" along the catch edge of the forked rotary latch that can cause complete disengagement of the detent pawl, after which the likewise spring-loaded motor vehicles forked rotary latch snaps into its opening position. In motor vehicles especially, an unintentional release of the lock must be prevented for safety reasons.

To guarantee against unintentional release of a rotary-latch lock, the locking contour of conventional rotary-latch locks is equipped with an "undercut", that is to say the detent pawl and the catch edge of the forked rotary latch are so coordinated with one another that the operation of disengaging the detent pawl is necessarily associated with a greater or lesser angular rotation of the forked rotary latch in the closing direction. The larger the "undercut", the higher the safety of the rotary-latch lock against unintentional release.

However, in the inherently effective principle of an 'undercut' of the locking contour, it is necessary to allow for the fact that, with an increasing "undercut", the unlocking forces also increase. Excessively high unlocking forces are likewise undesirable, because they have an adverse affect on the ease with which the rotary-latch lock is operated in order to release it.

An object of this invention is to therefore improve a rotary-latch lock of the relevant generic type, to the effect that, when used for locking functions on constructional parts subjected to oscillatory load, it can offer a high degree of locking safety without any effects on the unlocking forces.

A solution for improving such a rotary-latch consists of having the catch edge be a limiting edge of an approximately U-shaped catch recess of the forked rotary latch and into which a detent end of the catch member engages in the locking state. A rear edge of the detent end is located opposite a limiting edge of the catch recess at a distance which, in the event of oscillating movements of the forked rotary latch, allows the limiting edge to butt against the rear edge of the detent end of the spring loaded catch member. The limiting edge and the corresponding rear edge are designed over their length of mutual contact as return surfaces, which during the time when they butt against one another, cause an acceleration force acting in the direction of engagement to be transmitted to the detent end. Surface normals of the return surfaces form an acute angle with an engagement line determined by the direction of advance of the detent end. The return surface of the catch member is a straight edge on the detent end and the return surface of the rotary latch is a straight limiting edge of the catch recess. Shock pulses of the return surfaces butting against one another, with the catch member partially disengaged, ensure that the catch member is returned in the direction of engagement of the catch member and the rotary latch.

An advantageous embodiment of the invention is obtained by having an engagement line of the detent end of the catch member intersect the circular area covered by the forked rotary latch and at a distance from the pivot axis of the rotary latch. The return surface is arranged radially with respect to the pivot axis of the rotary latch.

The catch member is a pivotably mounted detent pawl. The surface normals of the return surfaces of the rotary latch and the detent pawl extend respectively at a distance from the pivot axes of the forked rotary latch and the detent pawl.

The detent end projects transversely relative to the main longitudinal extension of the detent pawl.

It is also advantageous if a transitional region between the return surface of the detent end and a fore-edge of the detent end is arcuately curved.

The limiting edge of the catch recess (equipped with the return surface) is set back from the catch edge as seen in the direction of advance of the detent end.

The detent end widens in a wedge-shaped manner in the direction of its fore-edge between the detent edge and the return surface of its rear edge.

Other objects, advantages and novel features of the present invention will become apparent from the following detailed description of the invention when considered in conjunction with the accompanying drawing.

BRIEF DESCRIPTION OF THE DRAWING

The FIG. shows a schematic of the rotary-latch lock of the invention detail.

DETAILED DESCRIPTION OF THE DRAWING

The FIG. shows a forked rotary latch 1 which is pivotedly mounted, approximately centrally about a vehicle pivot axle 2, fixedly arranged relative to the vehicle body and extending horizontally of the vehicle. The forked end of rotary latch 1 surrounds a closing bolt 3 of a locking lug (not shown) and thereby holds a cover, connected firmly to the locking lug in its closing position. The sealing plane of the cover extends essentially horizontally. In the static locking state shown, the closing bolt 3 bears against an upwardly facing fork edge of the forked rotary latch 1 under the expansion stress of a partially compressed rubber gasket (not shown).

The forked rotary latch 1 is blocked against pivoting by a detent pawl 4. A detent end **4*a* of pawl 4 engages into a catch recess 5 cut out from the circumference of the forked rotary latch 1. The detent end 4a of pawl 4 is approximately rectangular over its engagement length. The detent pawl 4 is mounted in the plane of the rotary latch about a pivot axle 6 fixedly arranged relative to the vehicle body. The detent end 4a projects from the detent pawl 4 at a right angle in relation to the vertical main longitudinal axis of the pawl 4. Since the engagement width and engagement depth of the detent end 4a are respectively smaller than the clear width and depth of the catch recess 5, the detent end 4a bears only by an upwardly facing straight detent edge 7 against a catch edge 8 of latch 1. The detent edge 7 is parallel to an upper edge of the detent end 4a and the generally approximately U-shaped catch recess 5 (in the upward direction). In contrast, the end fore-edge of the detent end 4a is located at a distance opposite a base edge of the catch recess 5 and its rear edge at a distance opposite the second lateral limiting edge of the catch recess 5. At the same time, the distance between the lateral limiting edge and the rear edge of the detent end 4a is calculated so that, in the event of a relatively small angular rotation of the forked rotary latch 1 in relation in the detent end 4a, the detent end 4a remains in an engaged position. Here the limiting edge of the latch 1 abutts against the rear edge of the detent end 4a**.

Corresponding edges of the detent 4 and of the latch are equipped with cooperations return surfaces 9 and 10. These surfaces ensure that when the limiting edge and the rear edge butt against one another, a shock pulse is exerted on the detent end 4a (from surface 10 acting on surface 9) to impart an acceleration force in the direction of engagement. The return surface 9 on the rear edges of the detent end 4a and the return surface 10 on the limiting edge of the catch recess 5 are each formed by a straight length portion and their cross-section consists of narrow plane rectangular surfaces. These rectangular surfaces extend obliquely (over their length) relative to the direction of engagement, in such a way that their surface (effective perpendicularly relative to their surface plane) form an acute angle with the engagement line determined by the direction of advance of the detent end 4a. Since the detent end 4a moves on a circular path during its engaging advance (because of the pivot mounting of the detent pawl 4), the engagement line between detent 4 and latch 1 is defined by the tangents of this circular path. The smaller the acute angle, the higher the force component which acts on the detent end 4a in the direction of engagement during the time when they butt against one another.

The course of the return surface 9 determines a wedge-shaped form of the detent end 4a by which the engagement width of the detent end 4a is increased. Moreover, a reduction of the clear width cross-section of the catch recess 5, as seen in the swing-out direction of the detent end 4a, is obtained as a result of the course of the return surface 10. Setting the angles between the engagement line of the detent end 4a and the surface normals of the two return surfaces 9 and 10 must therefore be a compromise between a sufficient force component in the direction of engagement and as short a distance as possible between the corresponding return surfaces 9 and 10 which is critical for the "return safety".

Despite a small precut of the locking contour formed by the catch edge 8 and the detent edge 7, the entry cross-section of the catch recess 5 need only be a little larger than the maximum engagement width of that portion of the detent end 4a that is located at then entry cross-section of the catch recess 5. As seen in the radial direction of the forked rotary latch 1, the limiting edge of the latch 1 (equipped with the return surface 10) is set back relative to that end of the limiting edge (equipped with the catch edge 8). Furthermore, a transitional region between the return surface 9 of the detent end 4a and the end fore-edge of the detent end 4a is arcuately curved. This means that the detent end 4a requires less pivoting clearance when it is swinging into and out of the catch recess 5.

Here, that limiting edge of the catch recess 5 equipped with the return surface 10 is straight over its entire extension. This is desirable for production reasons. This design is possible because the longitudinal extension of the limiting edge is radial in relation to the forked rotary latch 1, while the engagement line of the detent end 4a intersects the circular area covered by the forked rotary latch 2 at a vertical distance from the pivot axis 2. At the same time, the distance from the pivot axis 2 is calculated so that the limiting edge has to butt against the detent end 4a with its return surface 10 in front. Thus it is ensured that the return surface 10 also butts against the corresponding return surface 9 and not, for example in the curved transitional region at the rear edge of the detent end 4a.

Since the pivot axis 6 is arranged above and offset somewhat laterally to the circumscribed circle of the forked rotary latch 1, the surface normals of the return surfaces 9 and 10 each extend at an instantaneous distance from the pivot axis 2 and from the pivot axis 6. A butting of the return surfaces 9 and 10 against one another is thus converted into a pivoting movement of the detent pawl 4 in the clockwise direction, the direction of engagement.

In order to minimize the wear occurring as a result of the butting of the return surfaces 9 and 10 against one another, these should strike one another two-dimensionally. This is achieved if the return surfaces 9 and 10 extend parallel to or virtually parallel to one another.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Rotary-latch lock comprising:

a forked rotary latch which is blocked against pivoting in a position where it locks a closing bolt by a spring-loaded catch member;

the spring loaded catch member has a detent end which engages behind a centrally directed catch edge on the forked rotary latch, which catch edge extends from a circumferential edge of the forked rotary latch;

wherein the catch edge is formed as a side limiting edge of an approximately U-shaped catch recess;

wherein the detent end of the catch member engages in the recess during a locking state;

wherein a rear edge of the detent end is located opposite a limiting edge of the catch recess and at a distance which, in the event of oscillating movements of the forked rotary latch, allows the limiting edge to butt against the rear edge of the detent end, wherein another side limiting edge of the recess and a corresponding rear edge of the detent end of the catch member are designed over a length of mutual contact as return surfaces;

wherein during vibrations of the forked rotary latch, the return surfaces butt against one another to cause an engagement force to be transmitted to the detent end of the spring loaded catch member;

wherein planes of the return surfaces form an acute angle with an engagement line determined by the direction of advance of the detent end;

wherein the return surface of the detent end is a straight edge on the detent end, and wherein the return surface of the catch member is a straight limiting edge of the catch recess.

2. Rotary-latch lock according to claim 1, wherein an engagement line of the detent end intersects a circular area covered by the forked rotary latch at a distance from a pivot axis of the forked rotary latch; and wherein the return surface on the forked rotary latch is arranged radially with respect to its pivot axis.

3. Rotary-latch lock according to claim 1 wherein the catch member is a pivotably mounted detent pawl; and wherein planes of the return surfaces extend at a distance from the pivot axes of the forked rotary latch and the detent pawl.

4. Rotary-latch lock according to claim 3, wherein the detent projects transversely relative to a main longitudinal axis of the detent pawl.

5. Rotary-latch lock according to claim 4, wherein a transitional region between the return surface of the detent end and a fore-edge of the detent end is arcuately curved.

6. Rotary-latch lock according to claim 4, wherein a limiting edge of the catch recess equipped with the return surface is set back from the catch edge, as seen in the direction of advance of the detent end.

7. Rotary-latch lock according to claim 4 wherein the detent end widens in a wedge-shaped manner in the direction of a fore-edge between a detent edge that engages the catch edge and the return surface.

* * * * *